US012312877B2

(12) United States Patent
Kirk et al.

(10) Patent No.: US 12,312,877 B2
(45) Date of Patent: May 27, 2025

(54) CENTRALISER

(71) Applicant: Vulcan Completion Products UK Limited, Aberdeen (GB)

(72) Inventors: Ian Kirk, Aberdeen (GB); Andrew Kirk, Aberdeen (GB); Nathan Kirk, Aberdeen (GB)

(73) Assignee: VULCAN COMPLETION PRODUCTS UK LIMITED, Aberdeen (GB)

( * ) Notice: Subject to any disclaimer, the term of this patent is extended or adjusted under 35 U.S.C. 154(b) by 209 days.

(21) Appl. No.: 17/628,658

(22) PCT Filed: Jul. 21, 2020

(86) PCT No.: PCT/GB2020/051739
§ 371 (c)(1),
(2) Date: Jan. 20, 2022

(87) PCT Pub. No.: WO2021/014142
PCT Pub. Date: Jan. 28, 2021

(65) Prior Publication Data

US 2022/0251909 A1 Aug. 11, 2022

(30) Foreign Application Priority Data

Jul. 22, 2019 (GB) ..... 1910457

(51) Int. Cl.
*E21B 17/10* (2006.01)

(52) U.S. Cl.
CPC ..... *E21B 17/1078* (2013.01); *E21B 17/1085* (2013.01)

(58) Field of Classification Search
CPC .. E21B 17/10; E21B 17/1007; E21B 17/1014; E21B 17/1042; E21B 17/1078
See application file for complete search history.

(56) References Cited

U.S. PATENT DOCUMENTS 3,268,274 A * 8/1966 Ortloff ..... E21B 17/1078 175/325.4
4,266,607 A * 5/1981 Halstead ..... E21B 43/128 166/371

(Continued)

FOREIGN PATENT DOCUMENTS

CN 2869280 Y 2/2007
CN 204060551 U 12/2014

(Continued)

OTHER PUBLICATIONS

International Search Report and Written Opinion dated Oct. 16, 2020 for corresponding International Patent Application No. PCT/GB2020/051739.

(Continued)

*Primary Examiner* — Cathleen R Hutchins
(74) *Attorney, Agent, or Firm* — Tarolli, Sundheim, Covell & Tummino LLP

(57) ABSTRACT

A centraliser (10; 110) for centralising tubing (T) in a bore (B) comprises a body (12; 112), one or more blades (14; 114) extending radially outwards from the body (12; 112). One or more of the blades (14; 114) receives a blade standoff (20; 120) which is disposed on and extends radially outwards from the blade (14; 114) with which it is associated. The blade standoff (20; 120) is configured to space the blade (14; 114) from the bore (B) and is configured to form a galvanic inhibitor between the blade (14; 114) and the bore (B).

17 Claims, 5 Drawing Sheets

(56) References Cited

U.S. PATENT DOCUMENTS

| | | | | |
|---|---|---|---|---|
| 5,797,455 | A * | 8/1998 | Barron | E21B 17/1064 175/325.1 |
| 9,869,135 | B1 * | 1/2018 | Martin | E21B 17/042 |
| 2003/0010540 | A1 * | 1/2003 | Kirk | E21B 17/1042 175/325.5 |
| 2009/0242193 | A1 * | 10/2009 | Thornton | E21B 17/1085 175/325.1 |
| 2018/0038172 | A1 | 2/2018 | Budler | |

FOREIGN PATENT DOCUMENTS

| | | | |
|---|---|---|---|
| GB | 2275284 | A | 8/1994 |
| GB | 2358418 | A | 7/2001 |

OTHER PUBLICATIONS

GB Search Report dated Jan. 6, 2020 for corresponding GB Application No. 1910457.9.

* cited by examiner

CENTRALISER

RELATED APPLICATIONS

The present application is a U.S. National Stage application under 35 USC 371 of PCT Application Serial No. PCT/GB2020/051739, filed on 21 Jul. 2020, which claims priority to GB Application No. 1910457.9, filed on 22 Jul. 2019; the entirety of both of which are incorporated herein by reference.

FIELD

This relates to a centraliser for use in centralising tubing in a bore.

BACKGROUND

In the oil and gas exploration and production industry, hydrocarbon bearing formations are accessed by drilling a well borehole ("wellbore") from surface, the wellbore typically then being lined with metallic bore-lining tubing known as casing. Sections of casing are typically threaded together to form a casing string which is run into the wellbore, the annulus between the casing string and the wellbore then being filled with a settable material, typically cement, which amongst other things supports the casing string and the wellbore and provides a seal which prevents uncontrolled fluid flow up the annulus between the outside of the casing string and the inside of the wellbore.

Typically, the wellbore construction and completion process involves a number of stages, using drilling equipment and bore-lining tubing of successively smaller outer diameters. For example, following the drilling, casing and cementing of a given section of the wellbore, drilling equipment is directed through the cased section of the wellbore and operated to extend the wellbore. In some instances, the extended wellbore section may be left in this open hole condition. In other instances, the extended wellbore section may be lined and cemented.

Given its critical role in supporting the casing and/or the wellbore and preventing uncontrolled fluid flow up the annulus, it will be recognised that a poor cementing operation poses a significant operational risk for the operator.

One contributory factor to a poor cementing operation is inconsistent thickness of cement in the annulus caused by the casing string deflecting or moving away from the central longitudinal axis of the wellbore. In order to centre the casing string in the wellbore, devices known as centralisers (commonly referred to as "casing centralisers") are typically mounted around or form part of the casing string, the centralisers employed to maintain the casing string in a generally central position in the wellbore until the sheath of cement surround the casing has set.

Although centralisers are used extensively, there are a number of challenges and drawbacks with conventional tools and equipment. For example, directional drilling techniques have facilitated the creation of high angle and horizontal wellbores (referred to below collectively as horizontal wellbores) which deviate from vertical and thus permit the wellbore to follow the hydrocarbon bearing formation to a greater extent. Amongst other things, horizontal wellbores beneficially facilitate increased production rates due to the greater length of the wellbore which is exposed to the reservoir. Centralisers are particularly important in such extended reach wellbores, due to the weight of the horizontal portion of the wellbore, in the absence of suitable centralisation, acting to deflect the casing string onto the low side of the wellbore and thus inhibit progress of the casing string to the required depth. In extreme cases, progress of the casing string may be prevented and thus require intervention operations to be carried out, at great expense to an operator.

Thus, in addition to maintaining the position of the casing string, centralisers may assist in progress of the casing string in horizontal wellbores. Nevertheless, given the forces exerted on the centralisers, in particular in horizontal wellbores, centralisers are subject to wear which reduces performance. To combat wear, centralisers constructed from Zinc alloy have been developed. However, while centralisers constructed from Zinc alloy demonstrate greater wear performance, such centralisers have been found to be more susceptible to corrosion.

SUMMARY

According to a first aspect, there is provided a centraliser for centralising tubing in a bore, the centraliser comprising:

a body; and a blade extending radially outwards from the body; and a blade standoff disposed on and extending radially outwards from the blade, the blade standoff configured to space the blade from the bore, wherein the blade standoff comprises or is constructed from at least one of a composite material and a ceramic material and is configured to form a galvanic inhibitor between the blade and the bore.

In use, the centraliser may be configured for location on a conveyance, such as a casing string, liner string or the like, and run into the bore, e.g. a wellbore, the centraliser providing a standoff between the conveyance and the bore. In addition to providing a standoff between the conveyance and the bore, the centraliser comprises a blade standoff member which offsets the blade from the bore and which is configured to form a galvanic inhibitor between the blade and the bore by inhibiting the electrochemical potential difference between the centraliser and metallic components in the bore, in particular the sections of the bore which have been lined with metallic, typically steel, bore-lining tubing.

The centraliser provides a number of benefits. For example, the blade standoff acts as a spacer between the blade and the bore, resulting in reduced direct contact and thus wear of the blade. This in turn facilitates improved performance of the centraliser and the overall wellbore construction and completion operation by reducing the risk of damage to the centraliser and/or the wellbore which may otherwise require intervention operations to be carried out. Moreover, the blade standoff is configured to form a galvanic inhibitor which prevents or mitigates galvanic corrosion between the blade and sections of the bore which have been lined with metallic, e.g. steel, bore-lining tubing.

As described above, the centraliser comprises a body and a blade extending radially outwards from the body.

In particular embodiments, the centraliser may comprise or take the form of a solid body centraliser.

The body and the blade may form a unitary construction.

Alternatively, the body and the blade may comprise separate components configured for coupling together.

Where the body and the blade comprise separate components, the body and the blade may be coupled together by a coupling arrangement.

The coupling arrangement may comprise a mechanical fastener, such as a bolt, rivet or other suitable mechanical fastener.

Alternatively or additionally, the coupling arrangement may comprise a thread connection, a weld connection, adhesive bond, or other suitable coupling.

The body may comprise or may be constructed from a metallic material.

The body may comprise or may be constructed from a metal material and/or a metal alloy material.

In particular embodiments, the body may comprise or may be constructed from a Zinc alloy.

Alternatively or additionally, the body may comprise or may be constructed from one or more of: an Aluminium alloy; and Phosphor Bronze.

The body may be tubular.

As described above, the centraliser comprises a blade extending radially outwards from the body, but which is configured (e.g. shaped and/or dimensioned) so as to be spaced from the bore in use; in contrast to the conventional teaching that centraliser blades directly engage the bore wall.

The blade may be of any suitable form.

The blade may extend axially along the body.

The blade may extend at least partially circumferentially around the body.

In particular embodiments, the blade may extend axially along and at least partially circumferentially around the body, e.g. the blade may extend helically around the body.

The blade may comprise or may be constructed from a metallic material.

The blade may comprise or may be constructed from a metal material and/or a metal alloy material.

In particular embodiments, the blade may comprise or may be constructed from a Zinc alloy.

Alternatively or additionally, the blade may comprise or may be constructed from one or more of: an Aluminium alloy; and Phosphor Bronze.

The blade may be configured to receive the blade standoff.

The blade may comprise a recess configured to receive the blade standoff.

The centraliser may comprise a plurality of blades.

Where the centraliser comprises a plurality of blades, at least one of the blades may be provided with a blade-standoff.

Where the centraliser comprises a plurality of blades, a plurality of the blades may be provided with a blade-standoff.

In particular embodiments, all of the blades may be provided with a blade-standoff.

As described above, the centraliser comprises a blade standoff disposed on and extending radially outwards from the blade, the blade standoff configured to space the blade from the bore, the blade standoff configured to form a galvanic inhibitor between the blade and the bore.

The blade standoff may comprise or take the form of an elongate member, i.e. the blade standoff may have a length greater than its width.

The blade standoff may extend axially.

The blade standoff may extend at least partially circumferentially.

In particular embodiments, the blade standoff may extend axially along and at least partially circumferentially.

The blade standoff may form an at least partially helical shape.

The blade standoff may thus mirror the shape of the blade with which it is associated.

The blade standoff may comprise or may be constructed from a composite including aramid.

The blade standoff may comprise or may be constructed from a composite including a para-aramid, such as KEVLAR® or like material.

The blade standoff may comprise or may be constructed from a composite including a meta-aramid, such as NOMEX® or like material.

The blade standoff may comprise or may be constructed from a composite including carbon fibre, or like material.

The blade standoff may comprise or may be constructed from a hybrid composite, i.e. a composite having a combination of two or more reinforcement fibre types. For example, the blade standoff may comprise or may be constructed from a hybrid composite comprising two or more of: aramid fibres, such as para-aramid and/or meta-aramid fibres; and Carbon Fibre.

For example, the blade standoff may comprise or may be constructed from a Carbon KEVLAR® composite.

The blade standoff may comprise or may be constructed from a ceramic material.

The blade standoff may comprise or may be constructed from a ceramic composite material.

The blade standoff may take the form of a blade standoff member.

The blade standoff member may be disposed on the blade.

In particular embodiments, the blade standoff member takes the form of an insert configured for insertion into the recess in the blade.

Beneficially, the blade standoff acts as a spacer between the respective blade with which the blade standoff is associated and the bore, resulting in reduced direct contact and thus wear of the blade(s). This in turn facilitates improved performance of the centraliser and the overall wellbore construction and completion operation by reducing the risk of damage to the centraliser and/or the wellbore which may otherwise require intervention operations to be carried out. Moreover, the blade standoff is configured to form a galvanic inhibitor which prevents or mitigates galvanic corrosion between the blade and sections of the cased sections of the wellbore which have been lined with metallic bore-lining tubing.

In embodiments where the blade and/or the body are constructed from a material, e.g. zinc alloy, which is less noble than bore-lining tubing, e.g. steel, the blade standoff inhibits the effects of the electrochemical process of galvanic corrosion in which the less noble material acts as an anode and the more noble material acts as a cathode, which may otherwise occur within the wellbore environment; while simultaneously maintaining the wear resistance and formability benefits of a less noble material.

According to a second aspect, there is provided an assembly, comprising:

a conveyance; and one or more centraliser according to the first aspect.

In use, the assembly may be run into the bore, e.g. a wellbore, the centraliser providing a standoff between the conveyance and the bore. In addition to providing a standoff between the conveyance and the bore, the blade standoff member offsets the blade from the bore and is configured to form a galvanic inhibitor between the blade and the bore by inhibiting the electrochemical potential difference between the centraliser and metallic components, in particular the sections of the bore which have been lined with metallic, typically steel, bore-lining tubing.

The conveyance may take a number of different forms.

The conveyance may comprise or take the form of a tubing, in particular a tubing string.

The conveyance may comprise or take the form of a bore-lining tubing, in particular a bore-lining tubing string.

The conveyance may comprise or take the form of a casing, in particular a casing string.

The casing may take the form of a liner.

The conveyance may comprise production tubing, in particular a production tubing string.

The conveyance may comprise or take the form of a drill pipe, in particular a drill string.

According to a third aspect, there is provided a blade standoff for use in the centraliser of the first aspect.

A fourth aspect relates to use of the centraliser of the first aspect to centralise tubing in a bore.

It will be understood that for the purposes of the present disclosure the features defined above or described below may be utilised in isolation or in combination with any other defined feature. The claimed invention is defined by the appended claims.

DETAILED DESCRIPTION OF THE DRAWINGS

Figure 1:
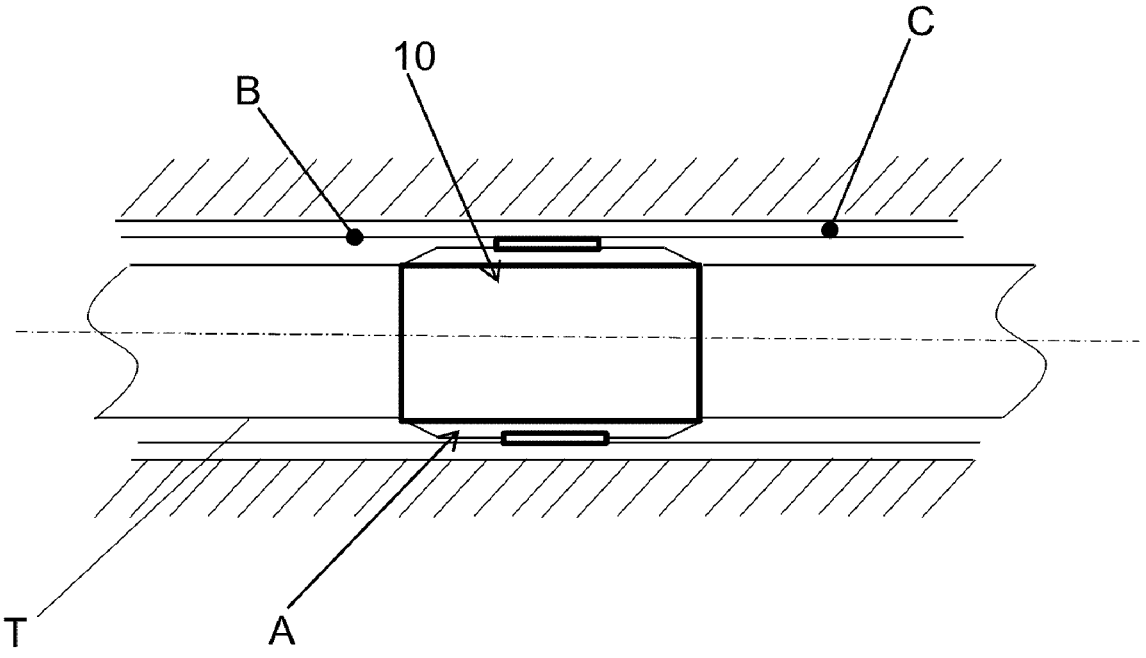
FIG. 1 shows a downhole assembly comprising a centraliser for centralising tubing in a bore.

Referring first to FIG. 1 of the accompanying drawings, there is shown a diagrammatic view of a downhole assembly A comprising a centraliser 10 and tubing T. As shown in FIG. 1, the bore B takes the form of a wellbore which has been at least partially lined with bore-lining tubing in the form of steel casing C. In the illustrated downhole assembly A, the tubing T takes the form of a casing string. However, it will be recognised that the tubing T may take a number of different forms, such as a bore-lining tubing string (e.g. casing string or liner string), a drill string, a work string or the like.

In use, the centraliser 10 is located on and is run into bore B on the tubing T, the centraliser 10 acts to centralise the tubing T in the bore B.

Figure 2:
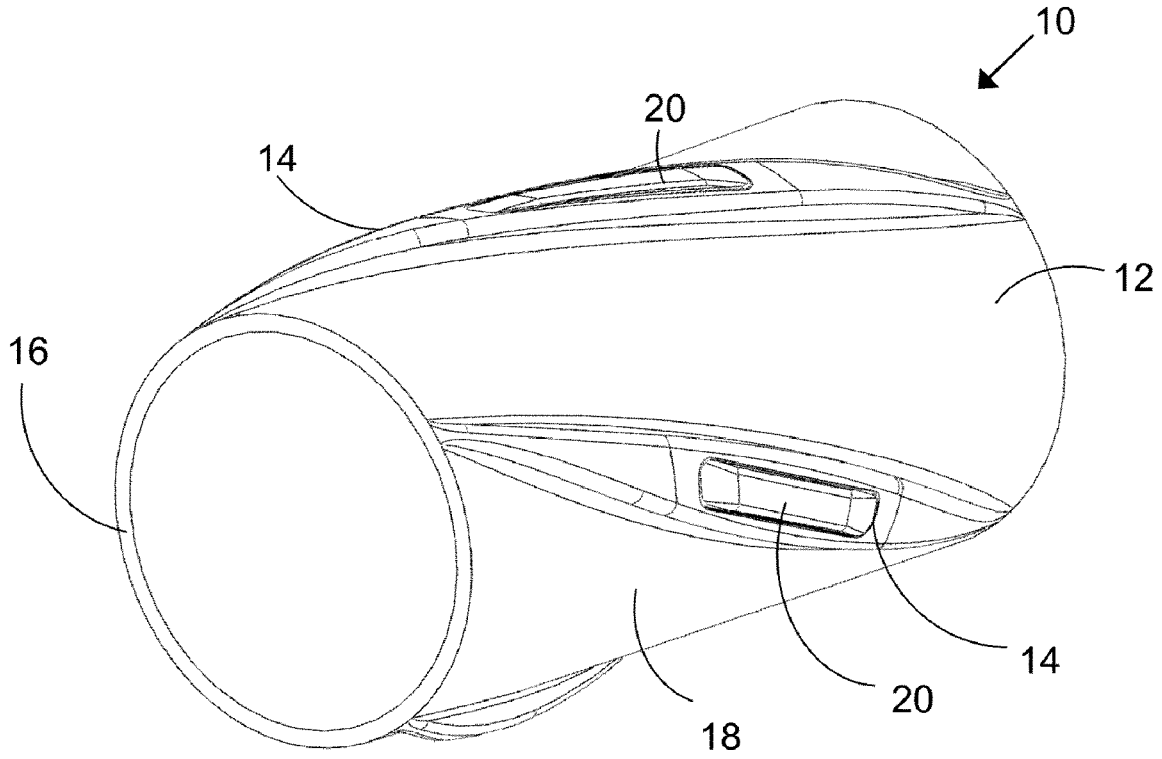
FIG. 2 shows a perspective view of the centraliser shown in FIG. 1.

Referring now also to FIG. 2 of the accompanying drawings, there is shown a perspective view of the centraliser 10. As shown in FIG. 2, the centraliser 10 takes the form of a solid body centraliser comprising a body 12 and blades 14, the body 12 and blades 14 forming a unitary construction. The body 12 and blades 14 are constructed from zinc alloy, zinc alloy demonstrating increased wear resistance compared to centralisers constructed from steel or like materials.

The body 12 is a substantially cylindrical construction, having an inner surface 16 defining a throughbore for locating the centraliser 10 on the tubing T and an outer surface 18. The blades 14 protrude radially from the outer surface 18 of the body 12, and in the illustrated centraliser 10, extend axially and partially circumferentially in a helical manner around the outer surface 18 of the body 12. It can be seen that in the illustrated centraliser 10, the blades 14 extend axially along the full length of the body 12. However, it will be appreciated that the blades 14 may be of any suitable form. For example, the blades 14 may only extend partially along the length of the body 12, the circumferential coverage of each blade 14 may be varied depending on the desired characteristics of the centraliser 10, and/or the number of blades 14 can be varied depending on the desired characteristics.

As shown in FIG. 2, the centraliser 10 comprises a number of blade standoff members 20 (two blade standoff members 20 are shown in FIG. 2). The blade standoff members 20 protrude above the surface of each blade 14, spacing the blade 14 from the wall of the bore B, more particularly spacing the blade 14 from the bore-lining tubing C of the bore B.

In the illustrated centraliser 10, the blade standoff members 20 are constructed from a composite material, with the blade standoff members 20 formed from Carbon KEVLAR® composite.

In the illustrated centraliser 10, each blade 14 is configured to receive a standoff member 20. However, it will be appreciated that in other embodiments only one or a subset of the blades 14 may be provided with a standoff member 20.

In use, the centraliser 10 is configured for location on the tubing T, which forms a conveyance for the centraliser 10. In addition to providing a standoff between the tubing T and the bore B, more particularly between the casing C, the blade standoff members 20 acts as spacers between the blades 14 and the bore B, resulting in reduced wear of the blade. This in turn facilitates improved performance of the centraliser 10 and the overall wellbore construction and completion operation by reducing the risk of damage to the centraliser 10 and/or the bore B which may otherwise require intervention operations to be carried out. Moreover, the blade standoff members 20 are configured to form a galvanic inhibitor which prevents or mitigates galvanic corrosion between the blades 14 and the casing C.

It will be recognised that where the blades 14 and the body 12 are constructed from a material, e.g. zinc alloy, which is less noble than bore-lining tubing, e.g. steel, the blade standoff members 20 inhibit the effects of the electrochemical process of galvanic corrosion in which the less noble material acts as an anode and the more noble material acts as a cathode, which may otherwise occur within the wellbore environment; while simultaneously maintaining the wear resistance and formability benefits of a less noble material.

Figure 3:
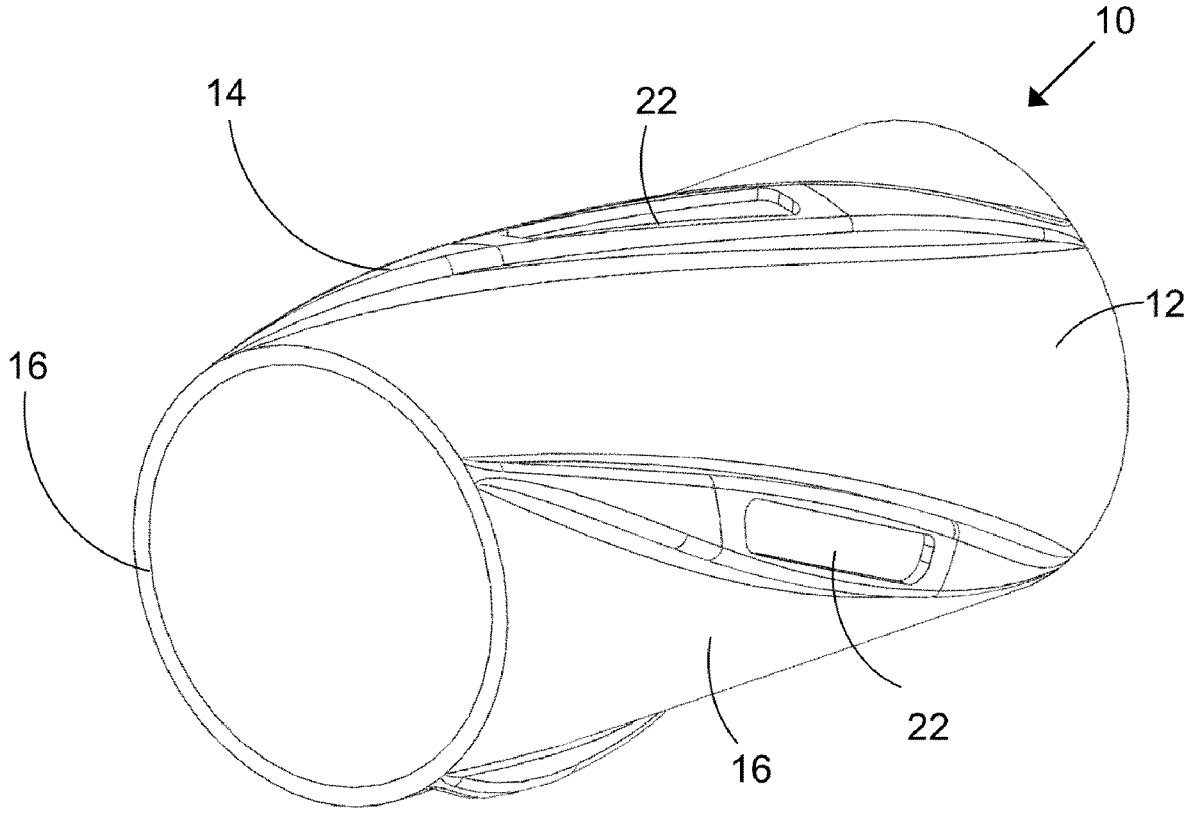
FIG. 3 shows a perspective view of the centraliser body, with blade standoff members removed.
Figure 4:
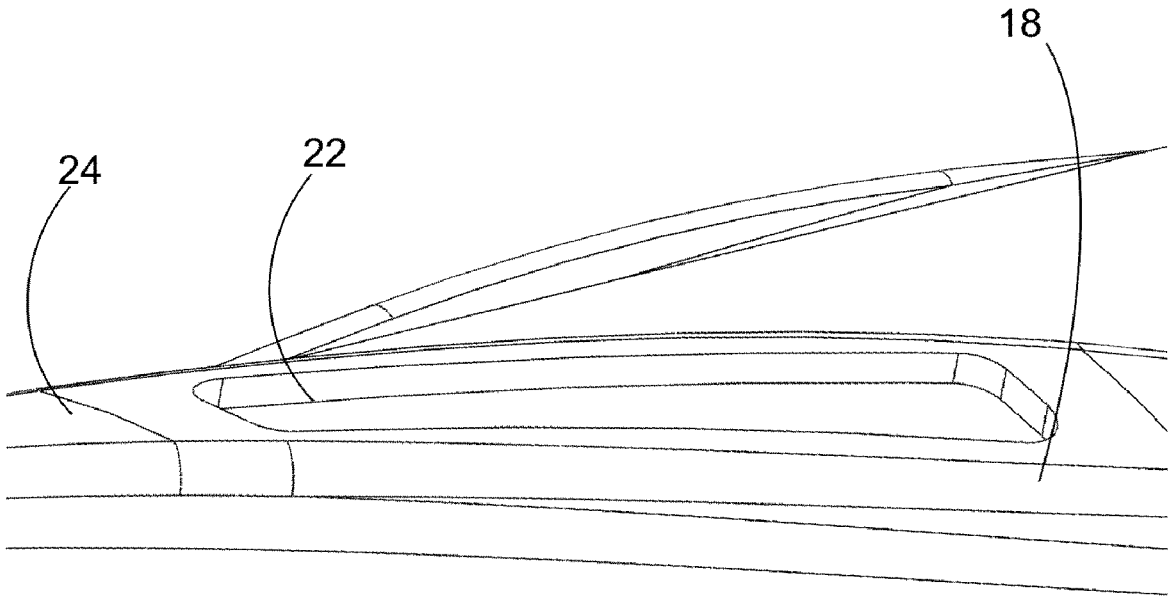
FIG. 4 shows an enlarged view of part of the centraliser shown in FIG. 3.

Referring now also to FIGS. 3 and 4 of the accompanying drawings, which show the centraliser 10 without the blade standoff members 20 in place, it can be seen that the blades 14 are each provided with a recess 22 for receiving the associated blade standoff member 20, the standoff member 20 forming an insert disposed with the recess 22.

As is shown within FIG. 4, the recess 22 is configured to ensure that when the blade standoff member 20 is seated and/or fixed within the recess 22, the blade standoff member 20 will protrude above the surface 24 of the blade 14 within which it is seated and/or fixed. In the illustrated centraliser 10, the blade standoff member 20 is held in place by an adhesive bond. However, it will be appreciated that the blade standoff member 20 may additionally or alternatively be held in place via contact friction or other fixing means.

In the illustrated centraliser 10, it can be seen that the recesses 22 are elongate, extending circumferentially and axially.

Figure 5:
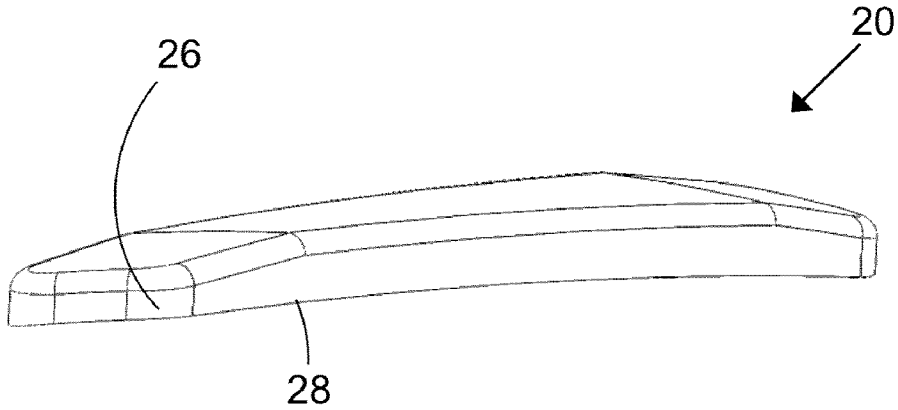
FIG. 5 shows a perspective view of a blade standoff member of the centraliser shown in FIG. 2.
Figure 6:
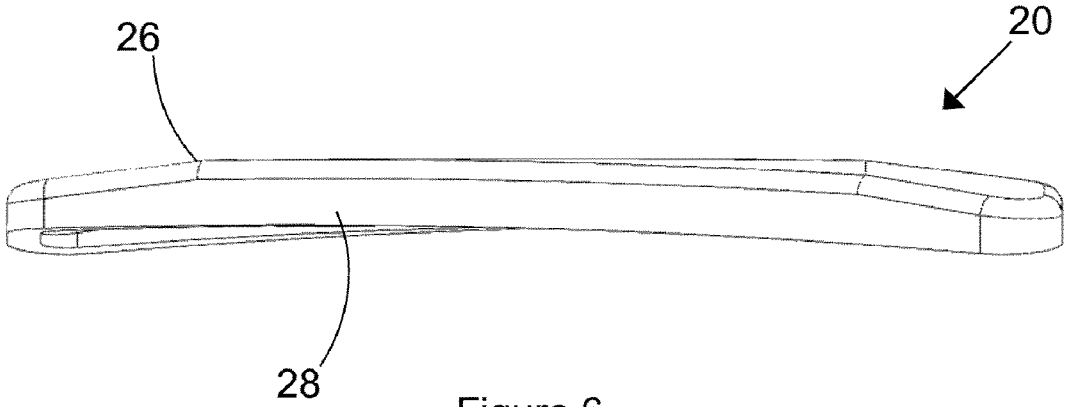
FIG. 6 shows an alternative perspective view of the blade standoff member shown in FIG. 5.
Figure 7:
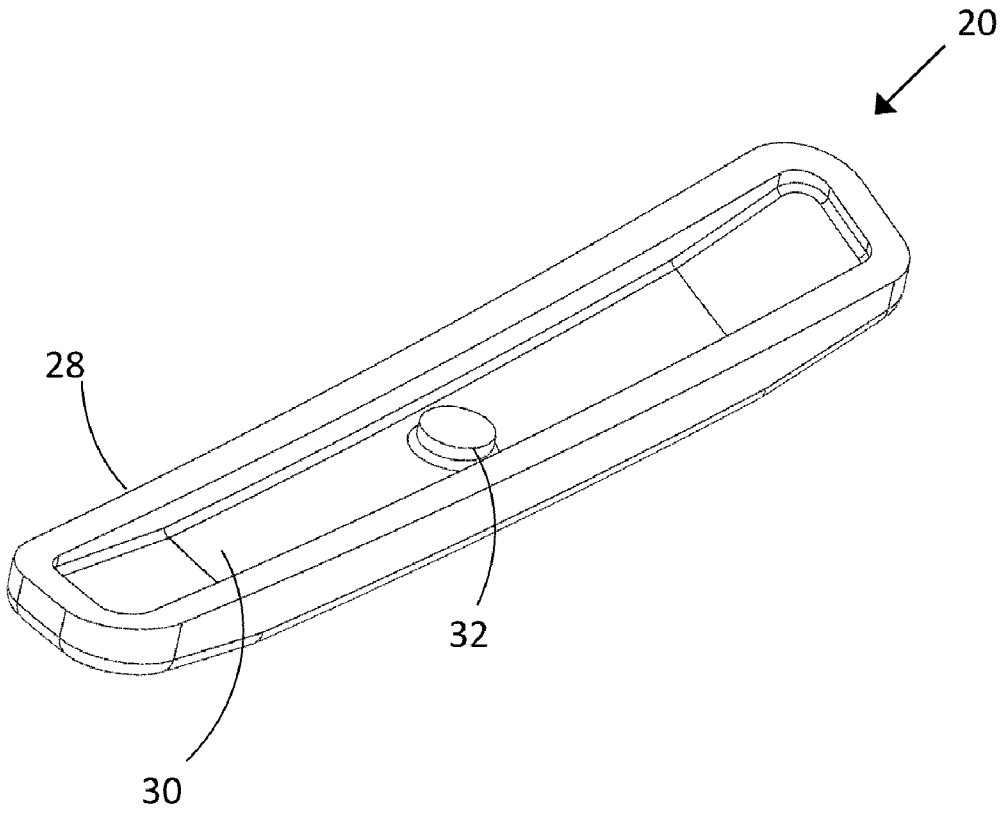
FIG. 7 shows an alternative perspective view of the blade standoff member shown in FIG. 5, showing the bottom surface of the blade standoff.

FIGS. 5, 6 and 7 of the accompanying drawings show perspective views of one of the blade standoff members 20 of the centraliser 10.

As shown, the blade standoff member 20 comprises an upper surface 26 for contact with the surrounding bore B and a lower surface 28 for contact with the blade 14 when the blade standoff member 20 is disposed within/upon the blade 14. In view of the foregoing, the blade standoff member 20 corresponds to the dimensions of the recess 22.

In particular, and as shown, as well as extending axially the blade standoff member 20 is curved in both axial and circumferential directions.

Referring in particular to FIG. 7, which shows the bottom of the blade standoff member 20, a slot 30 is formed in the bottom surface 28 of the blade standoff member 20. The slot 30 does not extend through the blade standoff member 20.

A boss 32 is formed within/upon the bottom surface 28 of the standoff insert 20 are configured to mate with the recess 22 formed within/upon the blade 14. It will be appreciated that this mating configuration is provided by way of an exemplary embodiment, with other suitable mating configurations being possible.

It will be recognised that the apparatus 10 described above is merely exemplary and that various modifications may be made without departing from the scope of the claimed invention.

Figure 8:
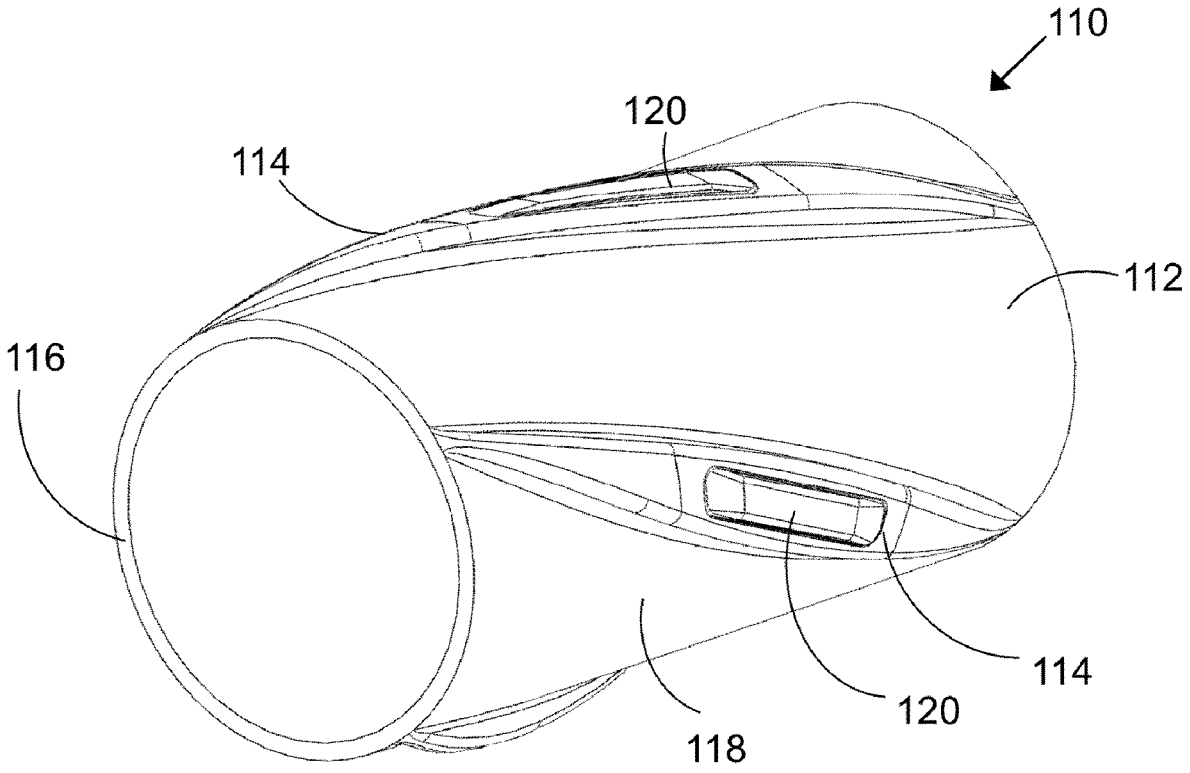
FIG. 8 shows a perspective view of an alternative centraliser for centralising tubing in a bore.

For example, FIG. 8 of the accompanying drawings shows a perspective view of an alternative centraliser 110. The centraliser 110 may form part of the downhole assembly A and may be used as an alternative to, or in addition to the centraliser 10 described above.

As shown in FIG. 8, the centraliser 110 takes the form of a solid body centraliser comprising a body 112 and blades 114, the body 112 and blades 114 forming a unitary construction. The body 112 and blades 114 are constructed from aluminium alloy.

The body 112 is a substantially cylindrical construction, having an inner surface 116 defining a throughbore for locating the centraliser 110 on tubing T and an outer surface 118. The blades 114 protrude radially from the outer surface 118 of the body 112, and in the illustrated centraliser 110 extend circumferentially in axially and partially circumferentially in a helical manner around the outer surface 118 of the body 112. It can be seen that in the illustrated centraliser 110, the blades 114 extend axially along the full length of the body 112. However, it will be appreciated that the blades 114 may be of any suitable form. For example, the blades 114 may only extend partially along the length of the body 112, the circumferential coverage of each blade 114 may be varied depending on the desired characteristics of the centraliser 110, and/or the number of blades 114 can be varied depending on the desired characteristics.

As shown in FIG. 8, the centraliser 110 comprises a number of blade standoff members 120 (two blade standoff members 120 are shown in FIG. 8). The blade standoff members 120 protrude above the surface of each blade 114, spacing the blade 114 from the wall of the bore B, more particularly from the casing C.

The blade standoff members 120 are constructed from a composite material, with the blade standoff members 120 in the illustrated centraliser 110 formed from Carbon KEVLAR® composite.

In the illustrated centraliser 110, each blade 114 is configured to receive a standoff member 120. However, it will be appreciated that in other embodiments only one or a subset of the blades 114 may be provided with a standoff member 120.

In use, the centraliser 110 is configured for location on the tubing T, which forms a conveyance for the centraliser 110. In addition to providing a standoff between the tubing T and the bore B, the blade standoff members 120 acts as spacers between the blades 114 and the bore B, resulting in reduced wear of the blade. This in turn facilitates improved performance of the centraliser 110 and the overall wellbore construction and completion operation by reducing the risk of damage to the centraliser 110 and/or the bore B which may otherwise require intervention operations to be carried out. Moreover, the blade standoff members 120 are configured to form a galvanic inhibitor which prevents or mitigates galvanic corrosion between the blades 114 and the casing C.

It will be recognised that where the blades 114 and the body 112 are constructed from aluminium alloy, which is less noble than bore-lining tubing, e.g. steel, the blade standoff members 120 inhibit the effects of the electrochemical process of galvanic corrosion in which the less noble material acts as an anode and the more noble material acts as a cathode, which may otherwise occur within the wellbore environment; while simultaneously maintaining the wear resistance and formability benefits of a less noble material.

The invention claimed is:

1. A centraliser for centralising tubing in a bore, the centraliser comprising:

a body, wherein the body comprises or is constructed from: Zinc alloy; Aluminium alloy; Phosphor Bronze or other metallic material having a lower electropotential or nobility than steel; and a blade extending radially outwards from the body, wherein the blade comprises or is constructed from: Zinc alloy; Aluminium alloy; Phosphor Bronze or other metallic material having a lower electropotential or nobility than steel; and a blade standoff disposed on and extending radially outwards from the blade, the blade standoff configured to space the blade from the bore, wherein the blade standoff comprises or is constructed from at least one of a composite material including aramid or a hybrid composite having a combination of two or more reinforcement fibre types and is configured to form a galvanic inhibitor between the blade and sections of the bore lined with steel bore-lining tubing.

2. The centraliser of claim 1, wherein the body and the blade form a unitary construction.

3. The centraliser of claim 1, wherein the body and the blade comprise separate components configured for coupling together.

4. The centraliser of claim 1, wherein at least one of:

the blade extends axially along the body; and/or the blade extends at least partially circumferentially around the body.

5. The centraliser of claim 1, wherein the blade is configured to receive the blade standoff.

6. The centraliser of claim 5, wherein the blade comprises a recess configured to receive the blade standoff.

7. The centraliser of claim 1, comprising a plurality of the blades, wherein at least one of the blades is provided with the blade-standoff.

8. The centraliser of claim 1, wherein the blade standoff comprises or takes the form of an elongate member.

9. The centraliser of claim 1, wherein at least one of:

the blade standoff extends axially; and/or the blade standoff extends at least partially circumferentially.

10. The centraliser of claim 1, wherein the blade standoff takes the form of a blade standoff member.

11. The centraliser of claim 10, wherein the blade standoff member forms an insert configured for insertion into the recess in the blade.

12. An assembly, comprising:

a conveyance; and one or more centraliser according to claim 1.

13. The assembly of claim 12, wherein the conveyance comprises a tubing.

14. The centraliser of claim 13, wherein the tubing comprises one of:

a bore-lining tubing;

a casing;

a liner;

production tubing; and drill pipe.

15. A method of using the centraliser of claim 1 to centralise tubing in the bore, comprising:

locating the centraliser on the tubing; and running the tubing into the bore, wherein the blade standoff offsets the blade from the bore so as to centralise the tubing in the bore.

16. The centraliser of claim 1, wherein:

the blade standoff comprises or is constructed from the composite material including aramid, and wherein the aramid is a para-aramid;

the blade standoff comprises or is constructed from the composite material including aramid, and wherein the aramid is a meta-aramid; or the blade standoff comprises or is constructed from the hybrid composite, and wherein the hybrid composite comprises a combination of aramid fibres and carbon fibres.

17. The centraliser of claim 1, wherein the body is tubular.

* * * * *